US006215058B1

(12) United States Patent
Molchak et al.

(10) Patent No.: US 6,215,058 B1
(45) Date of Patent: Apr. 10, 2001

(54) REMOTE CONTROLLED PAGE TURNER UTILIZING A PLURALITY OF MOVABLE FINGERS

(76) Inventors: Paul R. Molchak, 27850 Solamint Rd., No. 435, Santa Clarita, CA (US) 91351; Michael K. Taylor, 5008 Duverney, Laguna Hills, CA (US) 92653

( * ) Notice: Subject to any disclaimer, the term of this patent is extended or adjusted under 35 U.S.C. 154(b) by 0 days.

(21) Appl. No.: 09/501,487

(22) Filed: Feb. 9, 2000

Related U.S. Application Data

(63) Continuation-in-part of application No. 09/174,288, filed on Oct. 16, 1998, now abandoned.

(51) Int. Cl.[7] ..... G10G 7/00

(52) U.S. Cl. ..... 84/486; 84/489; 84/500; 84/487; 84/488

(58) Field of Search ..... 84/486, 487, 488, 84/489, 490, 491, 492, 493, 494, 495, 496, 500, 501, 503, 508, 510, 513, 516, 521; 40/531, 532

(56) References Cited

U.S. PATENT DOCUMENTS 4,463,651 * 8/1984 Hammer ..... 84/504
4,632,007 * 12/1986 Turcsany et al. ..... 84/487
4,644,675 * 2/1987 Berger et al. ..... 40/531
4,685,374 * 8/1987 Goldner ..... 84/487
4,691,909 * 9/1987 Owada et al. ..... 270/58
4,882,969 * 11/1989 Ricca ..... 84/487
5,373,722 * 12/1994 Shemoul ..... 84/486
5,471,277 * 11/1995 Fujioka et al. ..... 355/25
5,575,097 * 11/1996 Chou et al. ..... 40/531
5,942,706 * 8/1999 Leckie ..... 84/487

* cited by examiner

*Primary Examiner*—Jeffrey Donels
*Assistant Examiner*—Kim Lockett

(57) ABSTRACT

This invention turns pages of music using transparent fingers that are controlled by a hand or foot pedal, which is operated by the musician. The pages are turned by a self-contained electric motor that may be powered by a lightweight battery. The device is contained in an attractive case that doubles as a music holder. When desired, the pages may be reset to any point in the music by using a reset knob and the page turner will continue to turn the pages upon command from the musician.

14 Claims, 3 Drawing Sheets

REMOTE CONTROLLED PAGE TURNER UTILIZING A PLURALITY OF MOVABLE FINGERS

CROSS REFERENCE TO EARLIER APPLICATION

This application is a continuation in part of application Ser. No. 09/174,288 entitled "REMOTE CONTROLLED PAGE TURNER UTILIZING A PLURALITY OF MOVABLE FINGERS", filed Oct. 16, 1998, now abandoned.

BACKGROUND OF THE INVENTION

1. Field of the Invention

Fingers mounted on a disk for turning pages, and more particularly pages of music.

2. Description of the related art including information disclosed under 37 CFR Secs. 1.97–1.99.

When playing a musical instrument, the pages of the music must be turned at frequent intervals. This is particularly the case for pianists. This can result in an undesirable interruption of the musical flow. In cases where there are several instruments, as in chamber music, the points where page turning is necessary are different for each instrument. Violin music, for instance, has four or five times as much music per page as piano music. When accompanying other instruments or a singer, continuity of playing is essential. A pianist will often have a person present specifically to turn the pages. There is, therefore, a real need for a device that will enable a player to turn the pages himself without using his hands, actuating the device with a foot pedal. In the case of the organ, where the performer's feet are usually otherwise occupied, a lever actuated by the knee can be used. Such a device also has an application in the case of handicapped persons, such as singers, who have lost the use of their hands.

As early as 1874 Rinderknecht (U.S. Pat. No. 151,159) patented a page turning device that used a series of fingers to turn multiple sheets of music one at a time with a complex arrangement of a pulley, plates and rope actuated by a handle. This device is large, heavy and cumbersome. In 1890 (U.S. Pat. No. 425,810) Leevey disclosed a foot-operated mechanical device that turned multiple pages. It also employed a foot pedal, cords, springs and arms. It is also cumbersome. McNorton in 1903 (U.S. Pat. No. 739,904), Paris in 1907 (U.S. Pat. No. 849,424), Mallyon in 1908 (Great Britain Pat. No. 776), Souther in 1912 (U.S. Pat. No. 1,015,092) requiring single cut pages, Funk in 1914 (U.S. Pat. No. 1,096,617), Koop in 1916 (U.S. Pat. No. 1,185,683), Frorup in 1926 (Great Britain Pat. No. 256,840), Lambert in 1928 (Great Britain Pat. No. 292,270), Yaholnitsky in 1930 (U.S. Pat. No. 1,768,018), Gustafson in 1931 (U.S. Pat. No. 1,822,523) and Willing in 1941 (Great Britain Pat. No. 539,647) both turning a single leaf backwards and forwards, all disclosed complex page turning devices that each used a series of springs, wires or rope cables, gears, shafts, and mechanical foot or hand actuators to turn pages.

Giles in 1914 (U.S. Pat. No. 1,104,983) disclosed a page turning device that used a switch-actuated electric motor to turn a single page while Snively in 1932 (U.S. Pat. No. 1,883,034) disclosed an electric pedal to actuate the spring-controlled swinging arms to change the music form a device situated mounted above the music. Both of these devices are heavy and complex.

Peltola in 1924 (U.S. Pat. No. 1,512,708) disclosed a page turning device that used a combination of magnets to grasp the pages being turned. The sheets to be turned are also each provided with a small metal contact plate to be engaged by the magnets. This is a large and cumbersome device that requires each page to be individually prepared in advance.

SUMMARY OF THE INVENTION

The device is designed to turn the pages of music or books by means of a foot pedal or other switch mechanism, thus avoiding the need for the performer or reader to employ his hands for this purpose. In the case of music, it avoids the need for the performer to interrupt his playing to turn pages. The turning mechanism is contained in a case below the shelf upon which the music or book rests. The device may rest on or replace the conventional music stand used for an instrument of an orchestra or on a keyboard instrument. A person unable to use their hands normally may also use it. The driving force is provided by an electric motor that may be powered by a rechargeable battery, such as is used in a cordless power tool, or from the mains supply through a suitable transformer. A set of rods with transparent fingers projects through the top of the case to engage the pages. Upon actuation of the switch, one of the rods or fingers moves from the right side through a semicircle, carrying the page with it. The next actuation moves the next rod and the next page similarly.

This invention differs from earlier inventions by using an electric motor to controllably turn the pages of music. Unlike earlier designs, the device is lightweight and compact. The unit is also portable and simple in design and use. Multiple pages may be turned without the need to reset the page turning device. The device employs transparent fingers to turn the pages, thereby leaving the view of the musician unobscured. The invention is easily reset after the pages have been all or partial turned to re-begin at any point in the music. No special attachments are required on the pages of music and the music need not be cut into individual sheets or disassembled, in order to be used with the invention.

DETAILED DESCRIPTION OF THE PREFERRED EMBODIMENT

Figure 1:
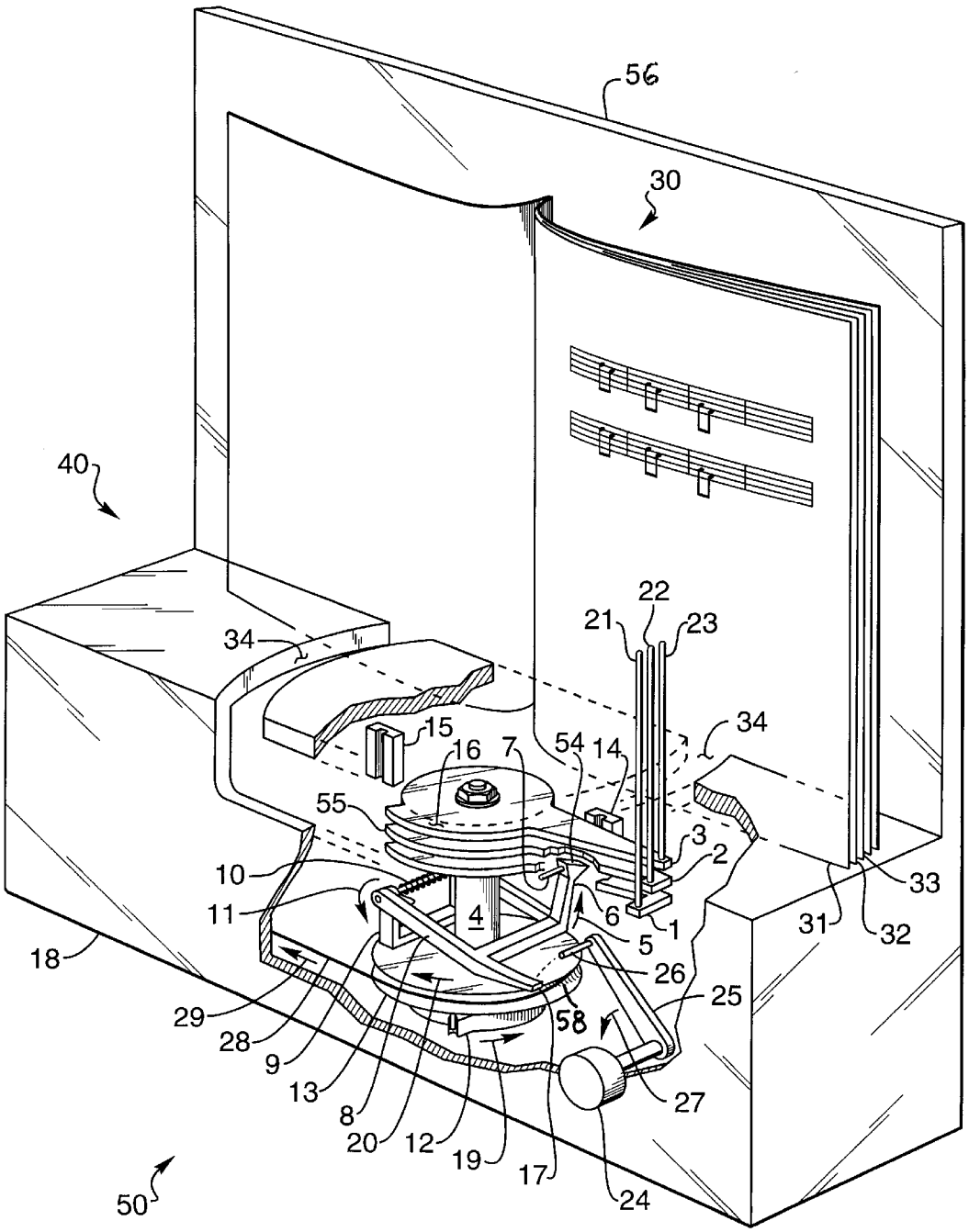
FIG. 1 illustrates a perspective view of the page turner showing three page turners and a sheet of music.

FIG. 1 provides a perspective view of a preferred embodiment of the remote controlled page turner, generally designated 50, comprising page turning mechanism 40 in a case 18 appropriate to hold bound leafed matter 30 such as a book, a magazine, and a musical score. As shown in FIG. 1, case 18 is partly cut away and phantomed, and book 30 is partly phantomed for clarity. Book 30 is shown in condition to turn a leaf, in this instance first leaf 31.

Page turning mechanism 40 consists of stationary shaft 4 affixed to the bottom interior surface of case 18. Each of plates 1, 2, and 3 are independently rotatably affixed to stationary shaft 4. Each of plates 1, 2, and 3 include a rod, respectively, 21, 22, and 23 and a notch 55. Affixed to an inner wall of case 18 is magnet 14 located to hold the far edges of plates 1, 2, and 3. Case 18 provides a ledge and back rest 56 for book 30, said ledge further having arcual slot 34 to pass rods 21, 22, and 23.

Carriage base 13 is rotatably affixed to stationary shaft 4, and carries bracket 9 to which is rotatably affixed to frame 8 by means of a hinge pin and torsion spring 10. Torsion spring 10 urges frame 8 to rotate in direction 11. Coil spring 12 is affixed by one end to carriage base 13, and by the other end to case 18, in order to urge rotation of carriage base 13 in direction 19. Frame 8 further includes hook 6 having pin 7 and ramp 54. Portions of plate 1 and 2 are cut away to show engagement of hook 6 with the far edge of a plate, in this instance plate 1, and engagement of pin 7 with the undersurface of a plate, in this instance also plate 1. Engagement of hook 6 and pin 7 is assured by upward force 5 thereon due to torsion spring 10.

Figure 2:
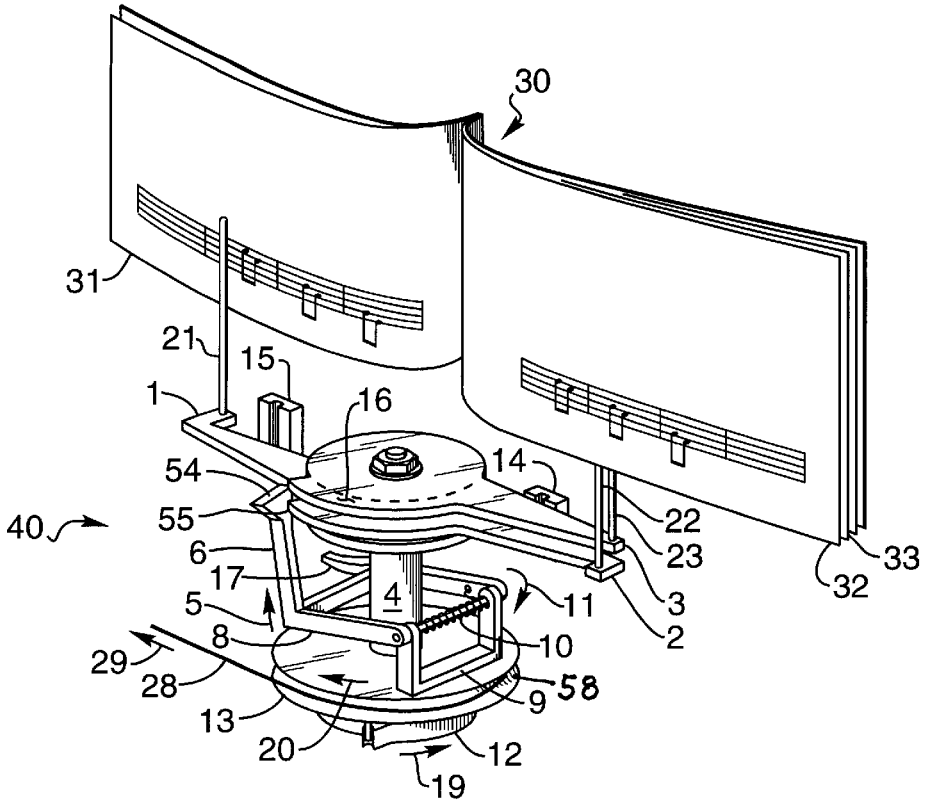
FIG. 2 illustrates a perspective view of the page turning mechanism.

FIG. 2 provides a perspective view of page turning mechanism 40 and book 30 after leaf 31 has been turned by rotation of plate 1 through approximately one-half turn responsive to rotary urging of hook 6, further responsive to rotary urging of carriage base 13. The far edge of plate 1, having arrived at the enabled position, is held by retainer magnet 15. Note that leaves 32 and 33 are not phantomed and each leaf rests on respective rods 22 and 23, awaiting turning.

In a preferred remote activating means depicted in FIGS. 1 and 2, carriage base 13 is a pulley having a groove 58 in which one end of a flexible tension member (cable) 28 is affixed, the other end subjected to tension. Tension in direction 29 forcibly urges carriage base 13 to rotate in direction 20 to execute a leaf turning.

Upon relaxation of tension 29, restorative rotary force 19 due to coil spring 12 returns hook 6 from the position shown in FIG. 2 to the position shown in FIG. 1, in condition to turn leaf 32. Plate 1 remains in the enabled position by dint of magnet 15. During the repositioning of hook 6, upward force 5 due to torsion spring 10 continues to urge the ramp 54 of hook 6 from notch 55 of plate 2 proximate the underside surface of plate 2 in annular surface 16 (projected) hinted by a dashed line. Upward movement of hook 6 ends as pin 7 contacts the underside of plate 2. Hook 6 continues to slide until near the end of an approximate half turn about stationary shaft 4, until the tip of hook 6 slips over the edge of plate 2. Plate 2 is now in condition to turn leaf 32 upon the next application of tension 29 to flexible tension member 28.

Whenever a desired number of leaves have been turned, one or more plates may be moved from the enabled position to the starting position by simply pressing a sequential combination of rods through a semicircle. However, to reset the plates in a ready-to-turn condition, it is required that hook 6 be moved below the undersurface of plate 1 or the lowest plate thus restored to readiness. Adverting to FIG. 1, therein is shown reset knob 24 which is urged to rotate in direction 27 using finger pressure such that lever 25 moves reset pin 26 into contact with projection 17 of frame 8. Continued urging overcomes force 11 of torsion spring 10 and moves hook 6 in the direction opposite that indicated 5. Subsequent moving of one or more plates from the enabled position to the starting position is sufficient when magnet 14 again holds the far plate edges. Leaves may remain interleaved or rearranged as desired.

The present invention has multiple preferred embodiments, including the use of a rotary solenoid (not illustrated but well known to one possessed of ordinary skill in the art) rotationally coupled to carriage base 13, further including known means of producing tension 29 by remote activation such as a variety of linear forcing devices such as a linear solenoid, an hydraulic cylinder, a pneumatic cylinder, a knee pedal, a foot pedal acting through a sheathed flexible cable or one or more pulleys, none of which are illustrated in light of being known.

Figure 3:
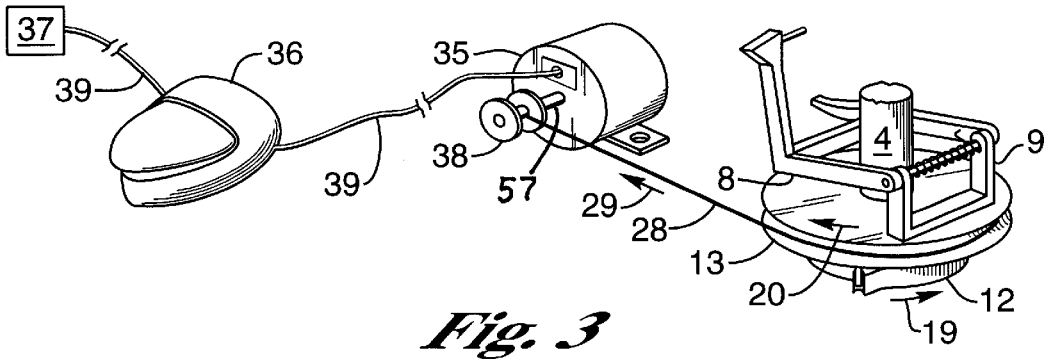
FIG. 3 illustrates a preferred embodiment of the carriage base and turning mechanism where the carriage base is a pulley with an electric motor and foot switch.

FIG. 3 illustrates a preferred embodiment wherein carriage base 13 is a pulley and flexible tension member 28 is affixed by the otherwise free end to spool 38. Spool 38 is rotated when electric motor 35 is electrically activated during closure of a contact in foot switch 36, which in turn controls electric power from source 37. The mounting base of motor 35 may be affixed to the bottom interior surface of case 18, and electrical conductor 39 may pass electric power from source 37 through a suitable conduit in said case 18. Continued rotation of shaft 57 containing spool 38 gathers flexible tension member 28 until carriage base 13 rotates through approximately one-half turn, or until carriage base 13 reaches a motion stop (not shown). Cessation of motor excitation enables coil spring 12 to urge frame 8 to the position ready to turn another leaf, while rewinding flexible tension member 28 from spool 38 to the groove 58 in carriage base 13.

Figure 4:
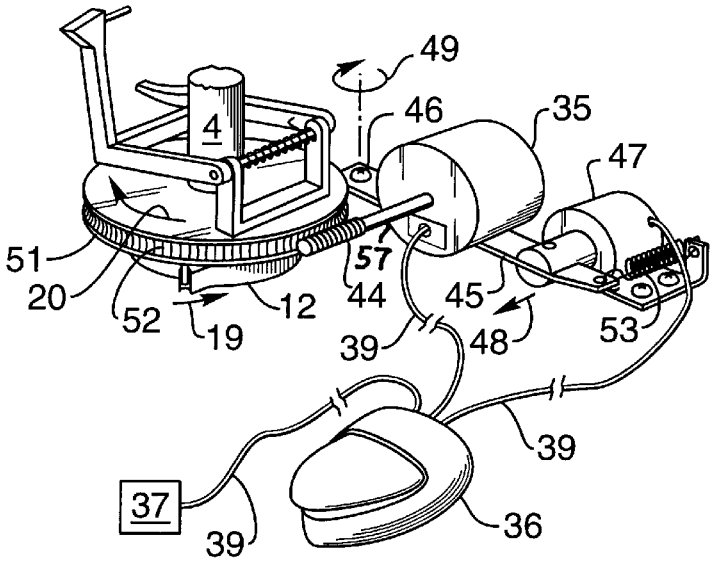
FIG. 4 illustrates a preferred embodiment with an electric motor and pinion gear.

FIG. 4 shows the preferred embodiment wherein electric motor 35, including attached pinion (gear) 44 on shaft 57, is rotatably affixed to case 18 (omitted) by a fastener 46 through a first hole of motor base 45. A second hole of the base is rotatably affixed by a pin to the armature of solenoid 47. A third hole in an extension of motor base 45 retains one end of tension spring 53. The opposite end of tension spring 53 is affixed to a holed or narrowed portion of an extension of the base of solenoid 47. The base of the solenoid is affixed to the bottom inner surface of case 18 in a position predetermined to cause tension spring 53 to rotate electric motor 25 in a direction opposite arrow 49 in the unpowered state. As foot switch 36 passes electric power from source 37 to both motor 35 and solenoid 47, the solenoid armature forcibly moves in direction 48 such that pinion 44 engages, teeth 52 of wheel 51. Said tooth engagement and continued running of motor 35 urge wheel 51 to rotate approximately one-half turn or until a motion stop (not shown) is reached. Conductors 39 are indicated broken to hint a prescribed remoteness of electric power source 37 or switch 36 from the leaf turning apparatus. The scope of the present invention is intended to encompass switches alternative to the foot switch previously described, not limited to hand held push-button switches, knee switches, elbow switches, and switches operable by other body portions pursuant to enabling the physically handicapped.

Figure 5:
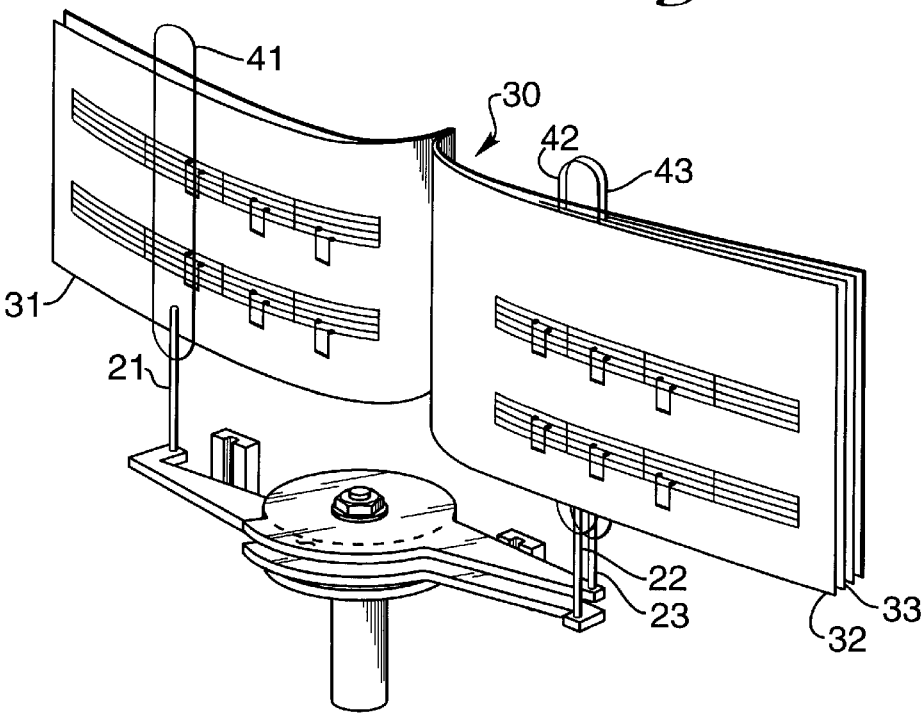
FIG. 5 depicts a preferred embodiment of transparent leaf turning fingers.

Cessation of electric power by release of foot switch 36 enables tension spring 53 to unmesh pinion 44 and teeth 52 while enabling coil spring 12 to urge wheel 51 in rotary direction 19 until the mechanism is in condition to turn another leaf FIG. 5 depicts a preferred embodiment of the leaf turning finger, wherein a rod 21 further includes an extending transparent finger 41. The transparent finger improvement enables the user to reexamine an unobscured left leaf. Advert to a facing leaf occurs often when music has repeats thereto, and in text that refers to earlier text or a graphical object on said facing leaf. Transparent fingers 42 and 43 are shown affixed to respective rods 22 and 23 in positions to turn another leaf Transparent fingers may be of transparent polymer such as polyethylene, polypropylene, polyacetal, polyamide, polyacrylics, acetates, and the like.

Whereas three plates are described for turning a sequence of three leaves, preferred embodiments of the present invention have a predetermined number of plates and fingers to turn a predetermined like number of leaves.

Obviously, other many modifications and variations of the present invention are possible in light of the above teachings. It is therefore to be understood that within the scope of the appended claims, the invention may be practiced otherwise than as specifically described.

What is claimed is:

1. A page turning device comprising:

a case for supporting leaves to be turned, said case having at least one arcual slot of approximately 180 degrees in the top thereof, at least one rod passing through the arcual slot for engaging the leaves and turning them, a plurality of concentric plates each having a rod attached thereto, such that as a plate rotates the rod moves in an arc, a stationary shaft for mounting the plates on, the plates mounted one above the other on the stationary shaft, each plate independently moveable on the stationary shaft such that the rods can independently move in an arc, a bracket having a frame for turning the plates, a bracket having a spring for upward biasing of the frame for engaging the plates individually for rotating the plates on the stationary shaft in series as the frame moves upward, the plates each having an annular surface on a portion of each plate extending radially further than the rest of the plate on a portion of its circumference for engaging the bracket, such that the bracket engages the annular area of the plate and turns each plate until the annular surface is removed from interfering with upward motion of the bracket for engagement of the next plate on the stationary shaft, a rotatable carriage base attached to the case for mounting the bracket thereon, such that when the carriage base turns the bracket rotates and moves the rods turning the leaves, a means for rotating the carriage base.

2. A page turning device as in claim 1 wherein, the means for rotating the carriage base comprises an electric motor having a shaft, the electric motor attached to the inside of the case, the shaft having a spool thereon, the spool attached to a flexible tension member wound around the spool such that when the shaft turns the spool takes up the flexible tension member, the carriage base has a groove for receiving the flexible tension member and when the motor is turned on the spool takes up the flexible tension member thereby rotating the carriage base, which in turn rotates the frame, thus the frame moves the plate such that the rod in turn moves a leaf.

3. A page turning device as in claim 1 wherein, the means for rotating the carriage base comprises an electric motor having a shaft, the electric motor attached to the inside of the case, the shaft having a pinion, the carriage base having teeth on its outer circumference for engaging the pinion such that as the motor shaft turns the carriage base rotates, which in turn rotates the frame, thus the frame moves the plate such that the rod in turn moves the leaf.

4. A page turning device as in claim 1 wherein, said rod includes a transparent finger which enables the user to see the leaf unobscured by said rod.

5. A page turning device as in claim 1 wherein there is, a means for resetting the rods to their starting position.

6. A page turning device as in claim 5 wherein, the means for resetting the rods has a reset knob, which enters the front of the case, when rotated moves the frame downward such that one or more rods can be returned to the end of the arcual slot, thereby allowing one or more leaves to be returned to the starting position.

7. A page turning device as in claim 1 wherein, the means for rotating the carriage base is an electric motor powered by a battery.

8. A page turning device as in claim 1 wherein, a back rest attached to the back of the case and extends above the top of the case to hold the leaves to be turned.

9. A page turning device as in claim 1 wherein there is, a means for holding the rods and leaves in the enabled position.

10. A page turning device as in claim 9 wherein, the means for holding the rods and leaves in the enabled position a retainer magnet attached to the back inside the case and attracts the plates so as to hold them in position after having been rotated from the starting position to the enabled position.

11. A page turning device as in claim 1 wherein there is, a means for holding the rods and leaves in the starting position.

12. A page turning device as in claim 1 wherein, the means for holding the rods and leaves in the starting position a magnet attached to the back of the inside of the case.

13. A page turning device as in claim 1 wherein there is, a means for holding the rods and leaves in the starting position.

14. A page turning device as in claim 1 wherein, the frame has a ramp for sliding under a plate so that the frame can return to the starting position after moving a rod to the enabled position.

* * * * *

UNITED STATES PATENT AND TRADEMARK OFFICE

CERTIFICATE OF CORRECTION

PATENT NO. : 6,215,058 B1
DATED : April 10, 2001
INVENTOR(S) : Paul R. Molchak and Michael K. Taylor It is certified that error appears in the above-identified patent and that said Letters Patent is hereby corrected as shown below:

Title page,
Add -- Attorney, Agent, or Firm - Gary D. Schnittgrund --

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*